US008684324B2

(12) United States Patent
Haydu et al.

(10) Patent No.: US 8,684,324 B2
(45) Date of Patent: Apr. 1, 2014

(54) TOP-ADJUSTING LEVELING FOOT

(75) Inventors: John P. Haydu, Hollywood, FL (US); Earl H. Covert, Coral Springs, FL (US)

(73) Assignee: John P. Haydu, Hollywood, FL (US)

( * ) Notice: Subject to any disclaimer, the term of this patent is extended or adjusted under 35 U.S.C. 154(b) by 11 days.

(21) Appl. No.: 13/593,979

(22) Filed: Aug. 24, 2012

(65) Prior Publication Data

US 2013/0048805 A1 Feb. 28, 2013

Related U.S. Application Data

(60) Provisional application No. 61/527,342, filed on Aug. 25, 2011.

(51) Int. Cl.
*F16M 11/24* (2006.01)

(52) U.S. Cl.
USPC ..... 248/188.4; 248/188.2

(58) Field of Classification Search
USPC ..... 411/383, 384, 546; 248/677, 188.2, 248/188.4, 188.5, 615; 108/161
See application file for complete search history.

(56) References Cited

U.S. PATENT DOCUMENTS

| | | | | |
|---|---|---|---|---|
| 1,417,639 | A * | 5/1922 | Sterner | 248/188.4 |
| 1,810,971 | A * | 6/1931 | Lee | 248/188.4 |
| 7,556,227 | B2 * | 7/2009 | Thuelig | 248/188.8 |
| 7,588,386 | B2 * | 9/2009 | Kielczewski et al. | 403/408.1 |
| 7,744,050 | B2 * | 6/2010 | de Toledo et al. | 248/188.3 |
| 7,780,128 | B2 * | 8/2010 | Walsberg | 248/188.4 |

* cited by examiner

*Primary Examiner* — Alfred J Wujciak
(74) *Attorney, Agent, or Firm* — Robert M. Downey, P.A.

(57) ABSTRACT

A top-adjusting leveling foot for installation on the leg of an object has an adjustment knob, an adjustment knob base with a bottom cavity and a non-circular passage extending axially through the center of the adjustment knob base, a threaded bushing with a top annular flange held within the bottom cavity of the adjustment knob base, and a drive stud assembly including a foot and a drive bar that has a lower threaded portion for engaging a partially threaded interior passage of the threaded bushing, and an upper bar portion sized and configured for engagement with the non-circular passage through the adjustment knob base. Rotation of the adjustment knob in a first direction axially advances the drive bar and lowers the foot and rotation of the adjustment knob in the opposite direction axially retracts the drive bar and raises the foot.

12 Claims, 3 Drawing Sheets

FIG.4

TOP-ADJUSTING LEVELING FOOT

This non-provisional patent application is based on provisional application Ser. No. 61/527,342 filed on Aug. 25, 2011.

BACKGROUND OF THE INVENTION

1. Field of the Invention

The present invention relates to leveling an object having one or more legs in contact with a surface and, more particularly, a top-adjusting leveling foot that can axially advance or retract the surface-contact point of the leg.

2. Discussion of the Related Art

A common problem associated with tables, chairs and other multi-legged objects is the wobbling effect that results from one or more of the legs being positioned on an unlevel surface. Often, the only recourse is sticking a folded piece of paper or magazine between the foot of the "short" leg and the ground surface, which can be unsightly and only provides a temporary solution to the problem.

In light of the problems commonly associated with tables and chairs, as well as other objects having more than one leg intended for contacting a ground surface, there exists a need for a top-adjusting leveling foot which can axially advance or retract the surface-contact point of the respective leg.

OBJECTS AND ADVANTAGES OF THE INVENTION

Considering the foregoing, it is a primary object of the present invention to provide a top-adjusting leveling foot for the purpose of axially advancing and/or retracting the surface-contact point of a leg.

It is a further object of the present invention to provide a top-adjusting leveling foot that can be pre-installed or retrofitted onto the leg of an object.

It is a further object of the present invention to provide a top-adjusting leveling foot that can be adjusted by rotating a knob on the top-side of the leg.

It is yet a further object of the present invention to provide a top-adjusting leveling foot that is easy to manufacture.

It is still a further object of the present invention to provide a top-adjusting leveling foot that is inexpensive to manufacture.

These and other objects and advantages of the present invention are readily apparent with reference to the detailed description and accompanying drawings.

SUMMARY OF THE INVENTION

The present invention is directed to a top-adjusting leveling foot for advancing and/or retracting the foot of a leg for the purpose of leveling an object having multiple surface-contact points. The top-adjusting leveling foot includes an adjustment knob having an open bottom that is sized for attachment (e.g., by brazing) to a top annular shoulder of an adjustment knob base. The adjustment knob base includes a centrally positioned non-circular (e.g., square, hex, triangle, etc.) opening extending through the entire thickness of the base. A threaded bushing includes a partially threaded interior passage and a top annular flange which is held within a bottom cavity of the adjustment knob base by a retaining ring. A drive stud assembly includes a threaded lower bar portion, an upper non-threaded bar portion having a multi-sided head (e.g., square, hex, triangle, etc.) congruently sized to engage the central opening on the adjustment knob base, and a foot attached to the threaded lower bar portion. In operation, the adjustment knob is rotated clockwise to axially advance the foot until the foot comes into contact with the ground surface.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Referring to the several views of the drawings, the top-adjusting leveling foot is provided for axially advancing and retracting the surface-contact point of a leg 100 of multi-legged object 102 is shown and is generally indicated as 10.

Figure 1:
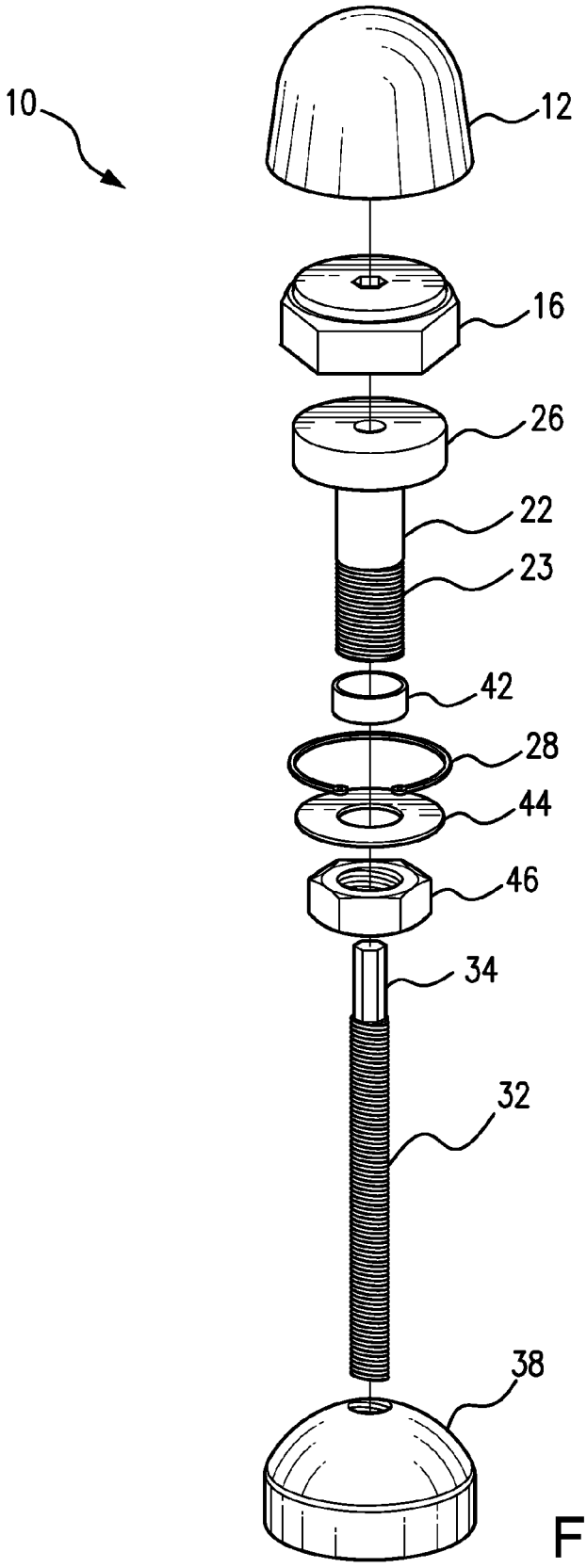
FIG. 1 is an exploded perspective view of the top-adjusting leveling foot of the present invention, shown as it is when disassembled.
Figure 2:
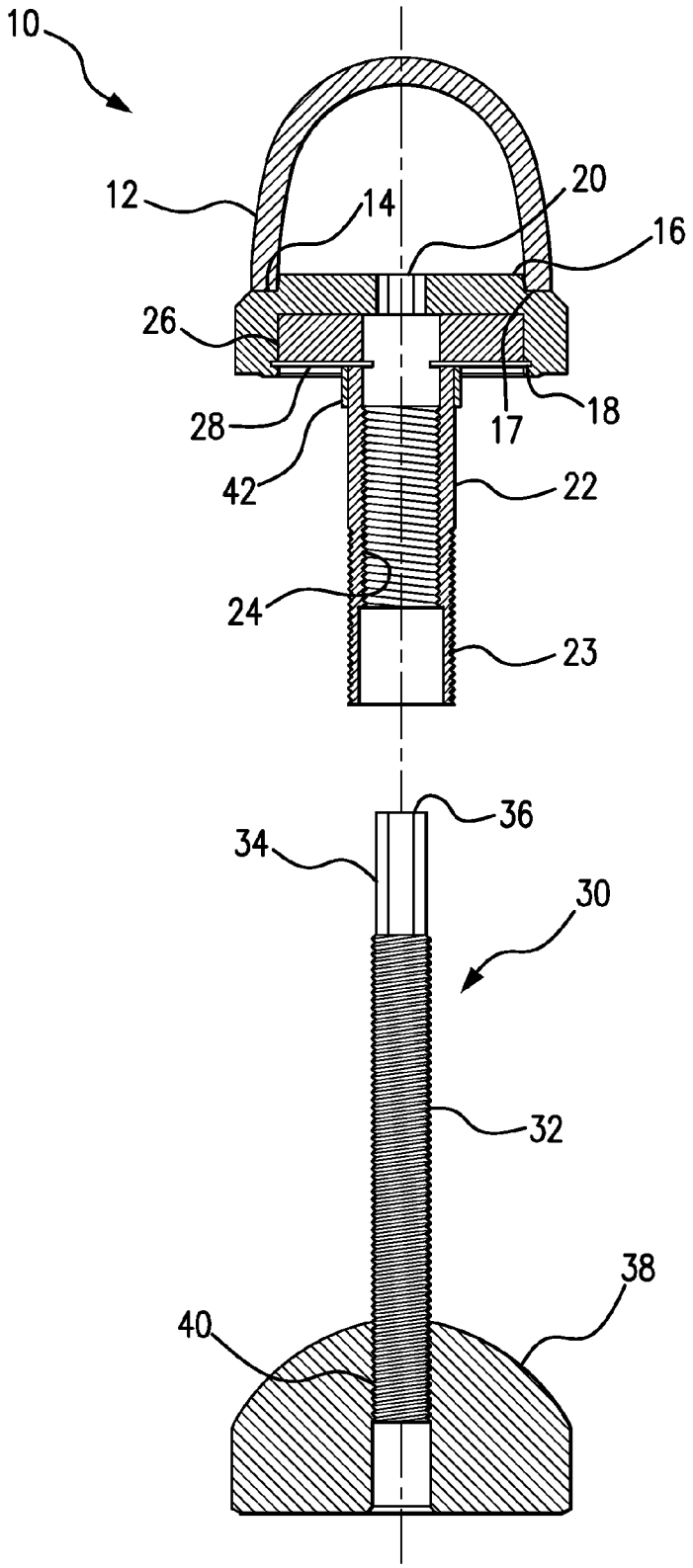
FIG. 2 is a partially exploded side elevational view of the top-adjusting leveling foot shown in partial cross-section.

Referring to FIGS. 1 and 2, the top-adjusting leveling foot 10 includes an adjustment knob 12 having an open bottom end surrounded by a bottom edge surface 14 that is sized to mate against a top annular shoulder 17 of an adjustment knob base 16. The bottom edge surface 14 is attached or otherwise adhered to the top annular shoulder 17 of the adjustment knob base 16 (e.g., by brazing). The adjustment knob base 16 includes a bottom cavity with an annular receiving notch 18 and a non-circular passage 20 extending lengthwise through the center of the base 16. A threaded bushing 22 has exterior threads 23 and a partially threaded interior passage 24 and a top annular flange 26 which is in abutment with the adjustment knob base 16 and is held in place by retaining ring 28, which is sized for engaging the annular receiving notch 18. The cavity formed between the bottom of the central portion of the adjustment knob base 12 and the retaining ring 28 is sufficient for allowing the annular flange 26 to freely rotate. The annular flange 26 may be coated with a thin layer of anti-rust lubricant for decreasing resistance due to friction as the flange 26 rotates. A drive stud assembly 30 includes a threaded bar 32, a non-threaded bar 34 having a non-circular head 36 sized to engage the passage 20 on the adjustment knob base 16, and a foot 38 having a partially threaded interior passage 40 sized to receive threaded bar 32. In one embodiment, the corners of the non-circular head 36 are radiused for easier installation into the non-circular passage 20 on the adjustment knob base 16. A portion of the threaded bar 34 is received in the partially threaded interior passage 40. In one embodiment of the invention, a chemical thread-locking formula is used to adhere the threaded bar 34 within foot 38. A slip ring 42 surrounds the shaft of the threaded bushing 22 and is freely moveable in relation to the bushing 22 and adjustment knob 12.

Figures 3, 4:
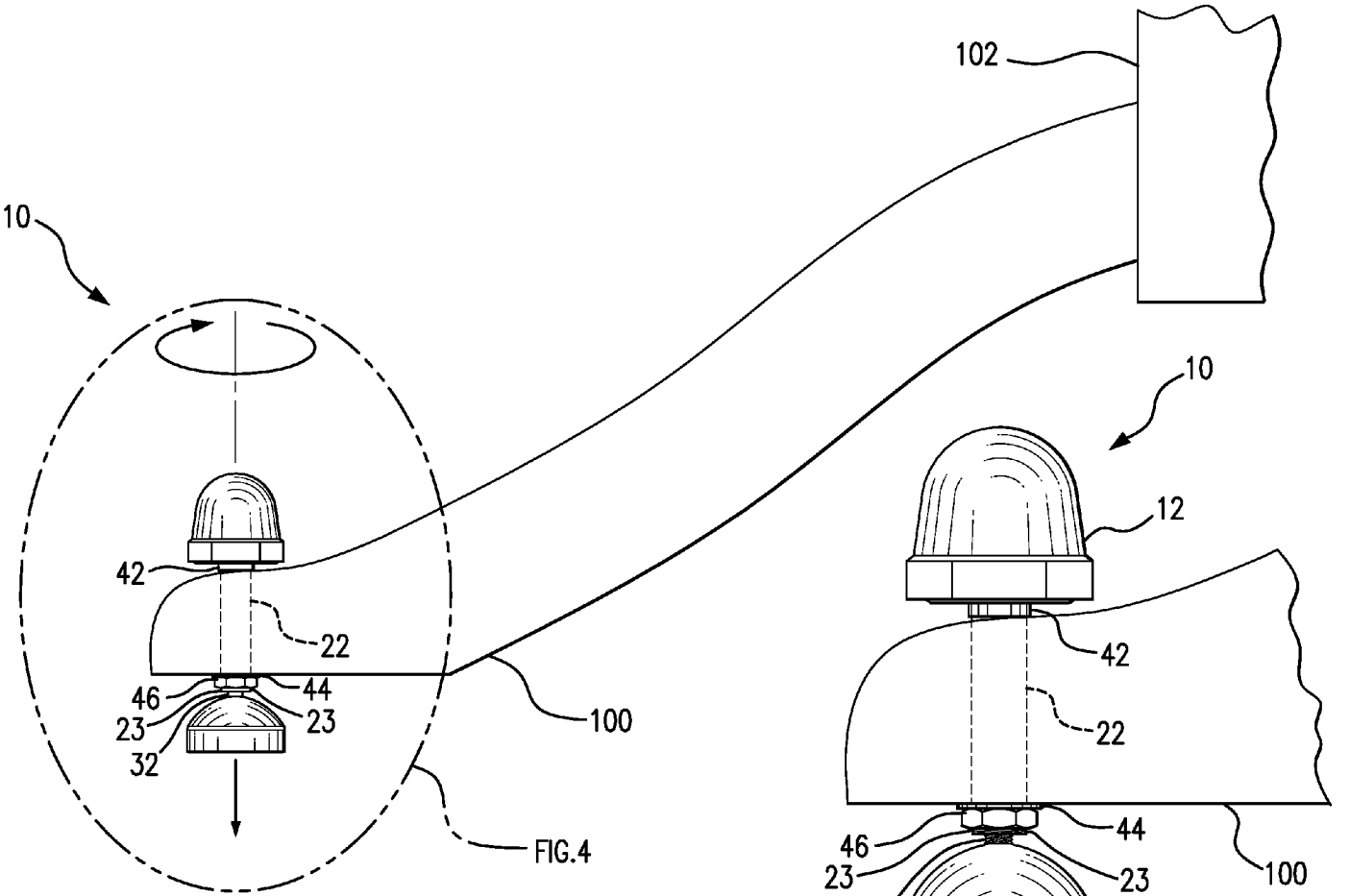
FIG. 3 is a side view of the top-adjusting leveling foot installed on the leg of a table.
FIG. 4 is an isolated view of the top-adjusting leveling foot installed on the table leg taken from the area indicated as "FIG. 4" in FIG. 3.

Referring to FIGS. 3 and 4, the top-adjusting leveling foot 10 is sized for installation on the leg 100 of table, chair, or other multi-legged object 102 having a hole sized to snuggly receive the threaded bushing 22. The angle of the entry hole is preferably perpendicular in relation to the ground surface, but may be angled as well. The slip ring 42 is sized larger than the hole and therefore prevents the adjustment knob 12 from coming into contact with the leg 100 in order to facilitate axial rotation of the knob 12 by a user regardless of the angle of the leg 100 where the hole is drilled relative to the ground surface. Multiple slip rings 42 having different widths may be provided for accommodating various angles used on table legs. A washer 44 and a nut 46 are sized to screw onto the outer threaded portion 23 on bushing 22 for tightening the hold on the leg 100 between the bushing 22 and nut 46. The drive stud assembly 30 may then be screwed into the partially threaded interior passage 24 of the threaded bushing 22, causing the non-circular head 36 of the threaded bar 32 to eventually come into contact with the congruently sized and shaped non-circular passage 20. To engage the passage 20 with the head 36, the adjustment knob 12 and foot 38 are axially rotated in the same direction until the head 36 and passage 20 are in alignment so that the head 36 is received into the passage 20, thereby establishing driving engagement of the adjustment knob 12 and base 16 with the drive stud assembly 30. Thereafter, installation is completed by using the adjustment knob 12 to screw the drive stud assembly 30 upwards until foot 38 contacts the bottom end of the bushing 22. The multi-legged object 102 can be set up on any irregular surface, such as asphalt, paver stones, tile, garden walk stones, grass, and dirt.

In operation, axial rotation of the adjustment knob 12 causes the drive stud assembly 30 to advance (clockwise axial rotation of adjustment knob 12) or retract (counter-clockwise axial rotation of adjustment knob 12). While the non-circular head 36 and non-circular passage 20 are shown as being hexagonally shaped in FIGS. 1 and 2, respectively, each may be formed in any complimentary shape that includes at least one angle suitable for allowing the passage 20 to drivingly engage and turn the head 36 of the drive stud assembly 30 when the knob 12 is rotated. Rotation of the adjustment knob 12 causes rotation of the adjustment knob base 16 and, as a result, the drive stud assembly 30 advances or retracts as the threaded bar 32 moves along the partially threaded interior passage 24. Generally, the one or more furniture legs 100 that are not contacting the ground surface should be targeted for adjustment, which is accomplished by rotating the adjustment knob 12 clockwise to advance the drive stud assembly 30 downwards until the foot 38 comes into contact with the ground surface so that all legs 100 of the multi-legged object 102 are in simultaneous contact with the ground surface, thereby eliminating undesirable wobbling of the furniture.

The top-adjusting leveling foot 10 allows a user to be able simply and quickly cinch down a foot 100 by rotating an adjustment knob 12 located on top of the leg 100, such as a table leg. However, many other applications have been considered possible such as laboratory equipment and other scientific equipment, as well as field service equipment. The top-adjusting leveling foot 10 also works well for projects requiring expedited set-up equipment, such as military operations.

In one embodiment, the top-adjusting leveling foot 10 includes a locking feature for preventing tampering or ambient movement of the settings once the feet have been set to perform their service.

Each of the parts of the top-adjusting leveling foot 10 may be formed using any suitable materials, such as stainless steel.

While the invention has been shown and described in accordance with several preferred and practical embodiments thereof, it is recognized that departures from the instant disclosure of the invention are fully contemplated within the spirit and scope of the invention and such changes, variations and modifications of the present invention are not to be limited except as recited in the following claims as interpreted under the Doctrine of Equivalents.

What is claimed is:

1. A top-adjusting leveling foot for installation on the leg of an object, said top-adjusting leveling foot comprising:

an adjustment knob having a bottom end;

an adjustment knob base fixed to the bottom end of said adjustment knob, and said adjustment knob base including a top side and a bottom cavity with an annular receiving notch within the bottom cavity and a non-circular passage extending axially through the center of said adjustment knob base between the bottom cavity and the top side of said adjustment knob base;

a retaining ring sized to be releasably locked in the annular receiving notch on said adjustment knob base;

a threaded bushing having a top end and a bottom end, and said threaded bushing including an annular flange at the top end that is sized for receipt in the bottom cavity, said threaded bushing including an outer surface having an upper zone and a lower zone extending from the upper zone to the bottom end of said threaded bushing, and the lower zone of the outer surface being threaded, and said threaded bushing further including an interior passage surrounded by an inner facing surface having a threaded central zone extending along a portion of a length of said threaded bushing and terminating below said top end of said threaded bushing and above said bottom end of said threaded bushing, said threaded bushing being sized for fitted insertion into a passage extending through the leg of said object, and whereby said adjustment knob and said adjustment knob base are rotatable relative to said annular flange;

a drive stud assembly including:

a foot;

a drive bar including a lower threaded bar portion having a bottom end attached to said foot, and a non-circular upper bar portion, and said non-circular upper bar portion and a section of said lower threaded bar portion being sized for insertion within the threaded central zone of the interior passage of said threaded bushing; and whereby rotation of said adjustment knob causes said adjustment knob base to rotate said drive stud assembly by engaging said non-circular upper bar portion, thereby causing the drive bar of said drive stud assembly to axially advance within the threaded central zone of the interior passage of said threaded bushing when said adjustment knob is rotated in a first direction and to axially retract when said adjustment knob is rotated in the opposite direction.

2. The top-adjusting leveling foot as recited in claim 1 further comprising a slip ring on said threaded bushing for maintaining clearance between said adjustment knob and the leg of said object.

3. The top-adjusting leveling foot as recited in claim 2 wherein said slip ring is made of stainless steel.

4. The top-adjusting leveling foot as recited in claim 1 further comprising a washer and a nut each sized for fitting onto the partially threaded shaft on said threaded bushing in between the bottom of the leg and said foot, and said washer and nut being structured and disposed for providing a tighter hold between the leg and said threaded bushing.

5. The top-adjusting leveling foot as recited in claim 1 wherein the non-circular passage is a hexagonal-shaped passage and said non-circular upper bar portion is a hexagonal-shaped bar.

6. The top-adjusting leveling foot as recited in claim 1 wherein the non-circular passage is a square-shaped passage and said non-circular upper bar portion is a square-shaped bar.

7. The top-adjusting leveling foot as recited in claim 1 wherein each of said adjustment knob, adjustment knob base, retaining ring, threaded bushing, and drive stud assembly is made of stainless steel.

8. A top-adjusting leveling foot for installation on the leg of an object, said top-adjusting leveling foot comprising:

an adjustment knob having a bottom end;

an adjustment knob base fixed to the bottom end of said adjustment knob, and said adjustment knob base including a top side and a bottom cavity with an annular receiving notch within the bottom cavity and a non-circular passage extending axially through the center of said adjustment knob base between the bottom cavity and the top side of said adjustment knob base;

a retaining ring sized to be releasably locked in the annular receiving notch on said adjustment knob base;

a threaded bushing having a top end and a bottom end, and said threaded bushing including an annular flange at the top end that is sized for receipt in the bottom cavity, said threaded bushing including an outer surface having an upper zone and a lower zone extending from the upper zone to the bottom end of said threaded bushing, and the lower zone of the outer surface being threaded, and said threaded bushing further including an interior passage surrounded by an inner facing surface having a threaded central zone extending along a portion of a length of said threaded bushing and terminating below said top end of said threaded bushing and above said bottom end of said threaded bushing, said threaded bushing being sized for fitted insertion into a passage extending through the leg of said object, and whereby said adjustment knob and said adjustment knob base are rotatable relative to said annular flange;

a slip ring on said threaded bushing for maintaining clearance between said adjustment knob and the leg of said object;

a drive stud assembly including:

a foot;

a drive bar including a lower threaded bar portion having a bottom end attached to said foot, a non-circular upper bar portion, and said upper bar portion and a section of said lower threaded bar portion being sized for insertion within the threaded central zone of the interior passage of said threaded bushing so that the lower threaded bar portion threadably engages within the threaded central zone of the interior passage; and whereby rotation of said adjustment knob causes said adjustment knob base to rotate said drive stud assembly by engaging said non-circular upper bar portion, thereby causing the drive bar of said drive stud assembly to axially advance within the threaded central zone of the interior passage of said threaded bushing when said adjustment knob is rotated in a first direction and to axially retract when said adjustment knob is rotated in the opposite direction.

9. The top-adjusting leveling foot as recited in claim 8 further comprising a washer and a nut each sized for fitting onto the partially threaded outer surface on said threaded bushing in between the bottom of the leg and said foot, and said washer and nut being structured and disposed for tightly holding said threaded bushing on the leg.

10. The top-adjusting leveling foot as recited in claim 8 wherein the non-circular passage is a hexagonal-shaped passage and said non-circular upper bar portion is a hexagonal-shaped bar.

11. The top-adjusting leveling foot as recited in claim 8 wherein the non-circular passage is a square-shaped passage and said non-circular upper bar portion is a square-shaped bar.

12. The top-adjusting leveling foot as recited in claim 8 wherein each of said adjustment knob, adjustment knob base, retaining ring, threaded bushing, slip ring, and drive stud assembly is made of stainless steel.

* * * * *